US008882532B1

(12) United States Patent
Akiyama et al.

(10) Patent No.: US 8,882,532 B1
(45) Date of Patent: Nov. 11, 2014

(54) DRIVER BOX FOR AN IMPROVED LIGHTING SYSTEM

(71) Applicant: Kenall Manufacturing Company, Gurnee, IL (US)

(72) Inventors: Steven Akiyama, New Lenox, IL (US); Kevin Dahlen, Lindenhurst, IL (US)

(73) Assignee: Kenall Manufacturing Company, Gurnee, IL (US)

( * ) Notice: Subject to any disclaimer, the term of this patent is extended or adjusted under 35 U.S.C. 154(b) by 0 days.

(21) Appl. No.: 14/100,476

(22) Filed: Dec. 9, 2013

(51) Int. Cl.
*H01R 13/62* (2006.01)
*F21V 23/00* (2006.01)
*H01R 13/629* (2006.01)

(52) U.S. Cl.
CPC ..... *F21V 23/008* (2013.01); *H01R 13/62977* (2013.01)
USPC ..... 439/372

(58) Field of Classification Search
USPC ..... 362/249.01; 439/157, 372
See application file for complete search history.

(56) References Cited

U.S. PATENT DOCUMENTS

| | | | | |
|---|---|---|---|---|
| 5,301,090 | A | 4/1994 | Hed | |
| 5,738,436 | A | 4/1998 | Cummings et al. | |
| 5,919,055 | A * | 7/1999 | Hattori | |
| 6,197,444 | B1 | 3/2001 | Vackar | |
| 6,276,948 | B1 * | 8/2001 | Okabe | 439/157 |
| 6,375,338 | B1 | 4/2002 | Cummings et al. | |
| 6,375,481 | B2 * | 4/2002 | Zweigle | 439/157 |
| 6,500,015 | B2 * | 12/2002 | Fukamachi et al. | 439/157 |
| 6,666,704 | B2 * | 12/2003 | Rodney, Sr. | 439/352 |
| 6,739,889 | B1 * | 5/2004 | Daggett et al. | 439/157 |
| 7,066,763 | B1 * | 6/2006 | Corwin et al. | 439/372 |
| 7,090,518 | B1 * | 8/2006 | Osada et al. | 439/157 |
| 8,016,602 | B2 * | 9/2011 | Wadoux | 439/157 |
| 8,147,261 | B2 * | 4/2012 | Horiuchi | 439/157 |
| 8,197,271 | B2 * | 6/2012 | Kobayashi et al. | 439/157 |
| 2003/0211764 | A1 * | 11/2003 | Fukamachi et al. | 439/157 |
| 2004/0082209 | A1 | 4/2004 | Zenaboni | |
| 2004/0087193 | A1 * | 5/2004 | Mikhail et al. | 439/157 |
| 2004/0105264 | A1 | 6/2004 | Spero | |
| 2007/0076459 | A1 | 4/2007 | Limpkin | |
| 2009/0073692 | A1 | 3/2009 | Berger et al. | |
| 2009/0290343 | A1 | 11/2009 | Brown et al. | |
| 2010/0085748 | A1 | 4/2010 | Kelly et al. | |
| 2010/0110684 | A1 | 5/2010 | Abdelsamed et al. | |
| 2010/0142202 | A1 | 6/2010 | Sugishita et al. | |
| 2010/0280677 | A1 | 11/2010 | Budike, Jr. | |
| 2011/0164411 | A1 | 7/2011 | Sparing et al. | |
| 2011/0249427 | A1 * | 10/2011 | Rooms et al. | 362/147 |
| 2011/0273877 | A1 | 11/2011 | Reed et al. | |
| 2012/0159821 | A1 | 6/2012 | Miletich et al. | |
| 2012/0176795 | A1 | 7/2012 | Lynch | |
| 2012/0217882 | A1 | 8/2012 | Wong et al. | |

(Continued)

*Primary Examiner* — Ross Gushi
(74) *Attorney, Agent, or Firm* — Marshall, Gerstein & Borun LLP

(57) ABSTRACT

A driver box includes a housing and a connection mechanism disposed in the housing. The housing is adapted to removably receive a driver adapted to supply electric power to at least one luminaire. The connection mechanism includes an actuator, a first electrical connector configured to be connected to the driver, and a second electrical connector configured to be electrically connected to the at least one luminaire. The actuator is operatively coupled to the second electrical connector. The actuator is movable between an unlocked position, in which the second electrical connector is disengaged from the first electrical connector, and a locked position in which the second electrical connector is in mating engagement with the first electrical connector.

25 Claims, 10 Drawing Sheets

(56) References Cited

U.S. PATENT DOCUMENTS

| | | | | |
|---|---|---|---|---|
| 2012/0249016 | A1 | 10/2012 | Smith | |
| 2012/0293086 | A1 | 11/2012 | Ishikita et al. | |
| 2012/0294000 | A1 | 11/2012 | Thomas et al. | |
| 2013/0003373 | A1 | 1/2013 | Hamby et al. | |
| 2013/0027935 | A1 | 1/2013 | Ladewig et al. | |
| 2013/0058108 | A1 | 3/2013 | Blincoe et al. | |
| 2013/0062724 | A1 | 3/2013 | Tokuyama et al. | |
| 2013/0063935 | A1 | 3/2013 | Thrailkill | |
| 2013/0077311 | A1 | 3/2013 | Kinnune et al. | |
| 2013/0141898 | A1* | 6/2013 | Rooms et al. | 362/101 |
| 2013/0208471 | A1 | 8/2013 | Lueken et al. | |
| 2013/0322099 | A1* | 12/2013 | Yasuji Fletcher et al. | 362/427 |

* cited by examiner

DRIVER BOX FOR AN IMPROVED LIGHTING SYSTEM

FIELD

This disclosure generally relates to driver boxes for lighting systems and, more particularly, to a driver box for a lighting system that includes a driver and a connection mechanism that facilitates a quick and easy change-out system for the driver.

BACKGROUND

Many commercial buildings, parking structures, transportation areas or structures (e.g., tunnels), and the like are equipped with lighting systems that typically include several luminaires or light fixtures configured to illuminate certain areas. Some luminaires, with LEDs for example, can be powered by drivers that are physically wired to the luminaires. These drivers often require maintenance (e.g., repair, replacement), which may, in turn, interrupt the operation of the lighting system. For example, portions of or the entire lighting system may have to be shut down while such maintenance is being performed. As another example, drivers and/or luminaires may have to be re-wired while carrying out and/or following such maintenance. As a result, maintenance can be time-consuming, costly, and inconvenient, for both maintenance technicians and users of the lighting systems.

SUMMARY

One aspect of the present disclosure provides a driver box that includes a housing and a connection mechanism disposed in the housing. The housing is adapted to removably receive a driver adapted to supply electric power to at least one luminaire. The connection mechanism includes an actuator, a first electrical connector configured to be connected to the driver, and a second electrical connector configured to be electrically connected to the at least one luminaire. The actuator is operatively coupled to the second electrical connector. The actuator is movable between an unlocked position, in which the second electrical connector is disengaged from the first electrical connector, and a locked position, in which the second electrical connector is in mating engagement with the first electrical connector.

Another aspect of the present disclosure provides a connection mechanism adapted to be disposed in a driver box that is adapted to be coupled to at least one luminaire and is adapted to removably secure a driver adapted to supply electric power to the at least one luminaire. The connection mechanism includes an actuator movable between an unlocked position and a locked position, a first electrical connector configured to be coupled to the driver, and a second electrical connector operatively coupled to the actuator and configured to be electrically connected to the at least one luminaire. When the actuator is in unlocked position, the second electrical connector is disengaged from the first electrical connector. Movement of the actuator from the unlocked position to the locked position drives the second electrical connector into mating engagement with the first electrical connector.

Another aspect of the present disclosure provides a lighting system that includes at least one luminaire and a driver box adapted to supply electric power to the at least one luminaire via at least one conductor. The driver box includes a housing, first and second drivers removably disposed in the housing, and first and second connection mechanisms disposed in the housing and electrically connected to the at least one luminaire. Each of the first and second drivers are configured to supply electric power to the at least one luminaire. The first and second connection mechanisms are movable between a first position, in which the first and second drivers are not electrically connected to the at least one luminaire, and a second position, in which the first and second drivers can be electrically connected to the at least one luminaire. When the first connection mechanism is in the first position and the second connection mechanism is in the second position, the first driver can be removed from the housing while the second driver can supply electric power to the at least one luminaire.

BRIEF DESCRIPTION OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed embodiments, and explain various principles and advantages of those embodiments.

DETAILED DESCRIPTION

The present disclosure is generally directed to a lighting system that includes a driver box coupled to one or more luminaires. The driver box includes one or more drivers configured to supply electric power to one or more of the luminaires. The driver box is configured to facilitate a quick and easy connection between the drivers and the one or more luminaires. The driver box is also configured to facilitate a quick and easy change out system for drivers in need of maintenance (e.g., need to be repaired, replaced). Beneficially, this allows drivers to be hot-swapped (i.e., drivers can be changed out without interrupting the operation of the lighting system (e.g., other drivers in the driver box can continue to supply electric power to the luminaires while the drivers in need of maintenance are changed out).

Figure 1:
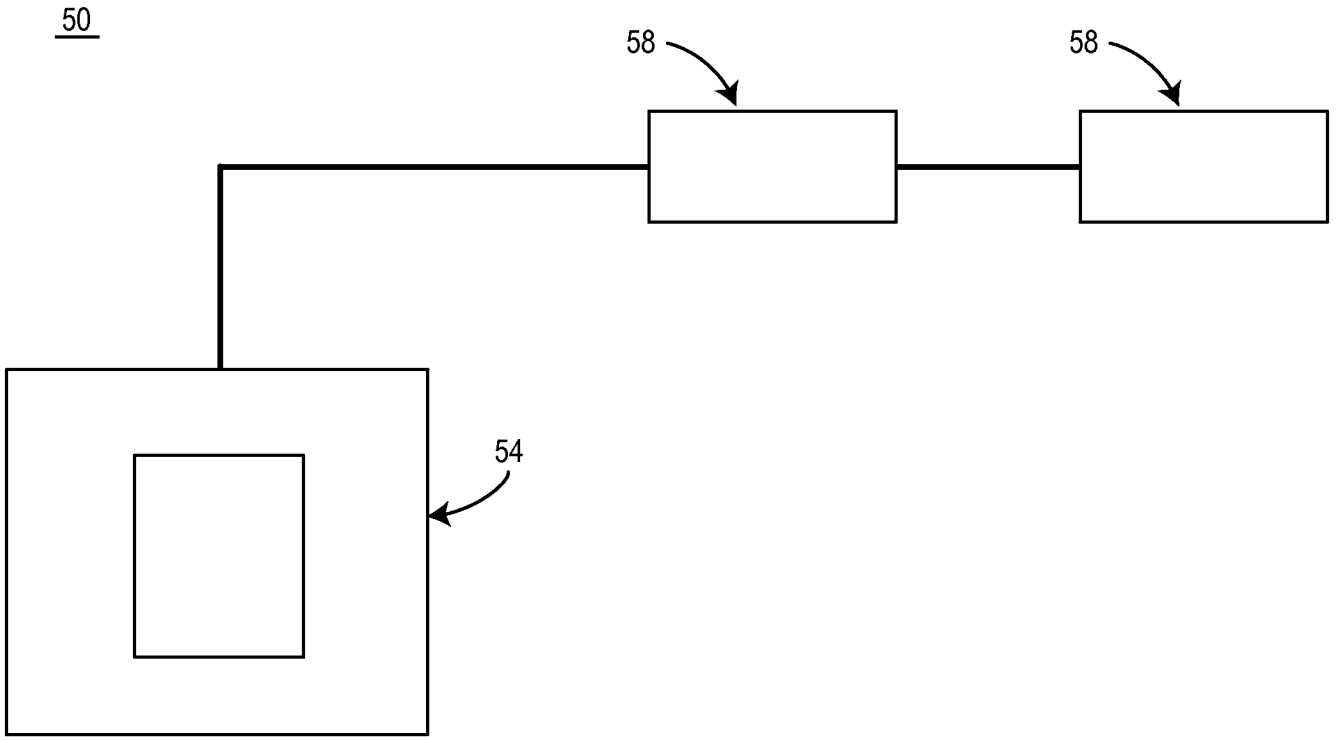
FIG. 1 is a schematic of a lighting system constructed in accordance with the teachings of the present disclosure.

FIG. 1 illustrates a lighting system 50 constructed in accordance with the teachings of the present disclosure. The lighting system 50 includes one or more driver boxes 54 each configured to supply electrical power to one or more luminaires 58. In this version, the lighting system 50 includes only one driver box 54. The driver box 54 includes one or more drivers configured to provide electric power to one or more of the luminaires 58 via or through one or more conductors 62 (e.g., one or more wires, one or more connectors). In some versions, each luminaire 58 includes a plurality of LED boards that each include a plurality of LEDs disposed thereon. Each LED board can, for example, have a capacity of 48 LEDs to result in a total of 192 LEDs for each luminaire 58. In these versions, the four LED boards can emit up to 15,000 lumens of light. Alternatively, each luminaire 58 can include more or less LED boards amounts of LED boards (including a single LED board) that each include other amounts of LEDs can be employed. The luminaires 58 can, for example, include one LED board, two LED boards, three LED boards, twelve (12) LED boards, twenty-four (24) LED boards, or some other number of LED boards. Alternatively or additionally, each LED board can include greater or fewer LEDs disposed thereon. For example, each LED board can include four (4) LEDs, six (6) LEDs, twenty-four (24) LEDs, or some other number of LEDs. In other examples, the luminaires 58 can include other lighting boards, such as, for example lighting boards that include different types of light-emitting components (e.g., fluorescent, incandescent, or plasma lights).

Although not specifically depicted herein, the lighting system 50 can be included or employed in a parking garage (or a floor or section of the parking garage), commercial building (or a portion thereof), roadway, tunnel, or other structure (or a portion thereof), residential home or building, or other indoor or outdoor space or environment. For example, if the lighting system 50 is installed on one floor of a commercial building, one or more luminaires 58 can be installed at various locations in the ceiling of the floor and a driver box 54 can be located in a separate control room on that same floor or on a different floor. As another example, if the lighting system 50 is installed in a tunnel, one or more luminaires 58 can be installed on the ceiling of the tunnel and a driver box 54 can be located in a separate control room, on one of the sides of the tunnel, near a ground level of the tunnel, or in other locations. In some versions, a plurality of luminaires 58 can be arranged in an end-to-end series (e.g., on the ceiling of a tunnel) or in a matrix-type configuration, where needed.

In other versions, the lighting system 50 can include two, three, four, or any other number of driver boxes 54. The driver box(es) 54 can, in some versions, be located remotely from each of the one or more luminaires 58 to which it (and more specifically its drivers) supplies electric power. The driver box(es) 54 can, for example, be located a distance of ten feet, twenty feet, thirty feet, or some other distance from each of the one or more luminaires 58 to which it supplies electric power.

Figure 2:
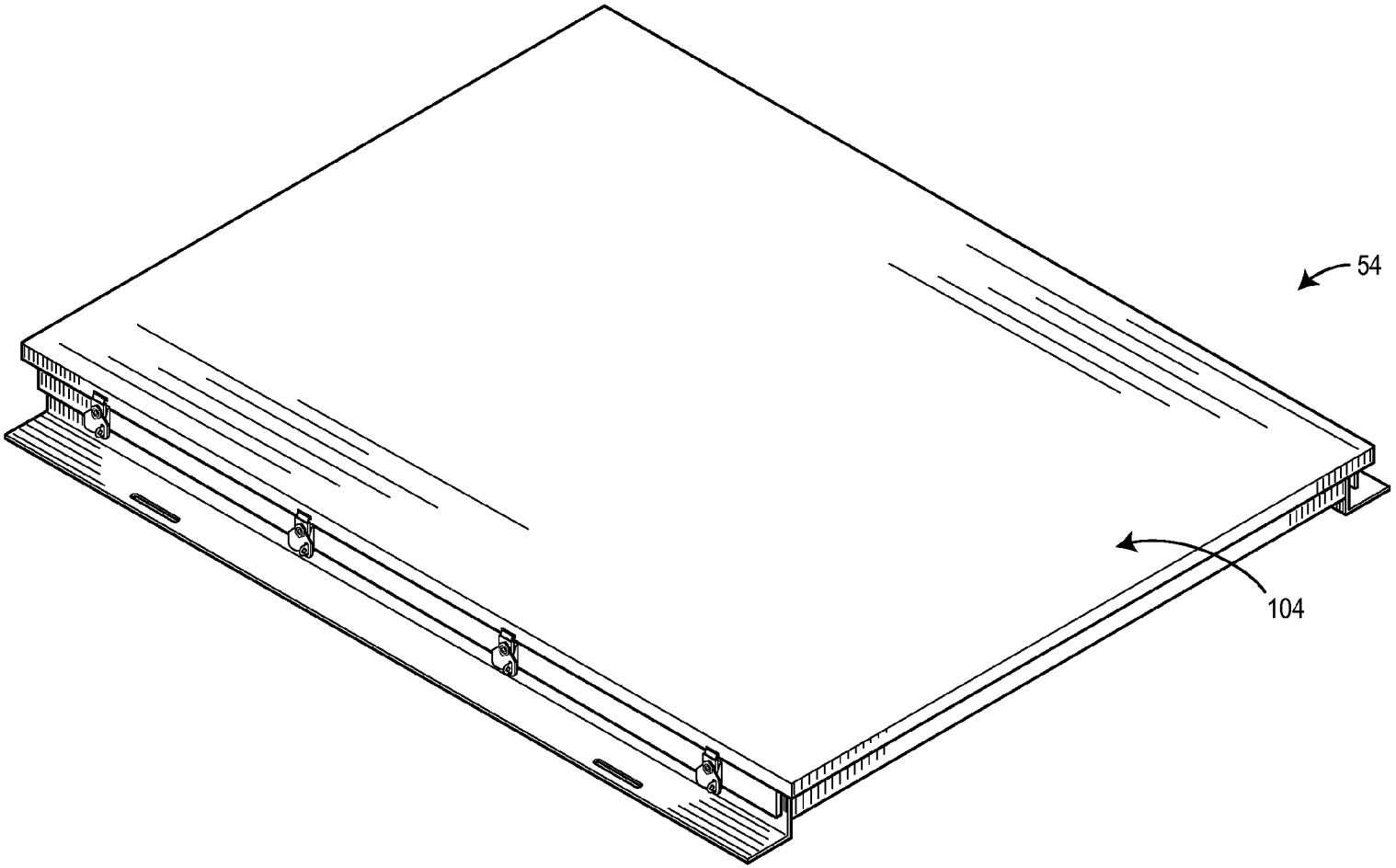
FIG. 2 is a perspective view of one example of a driver box employed in the lighting system of FIG. 1.
Figure 3:
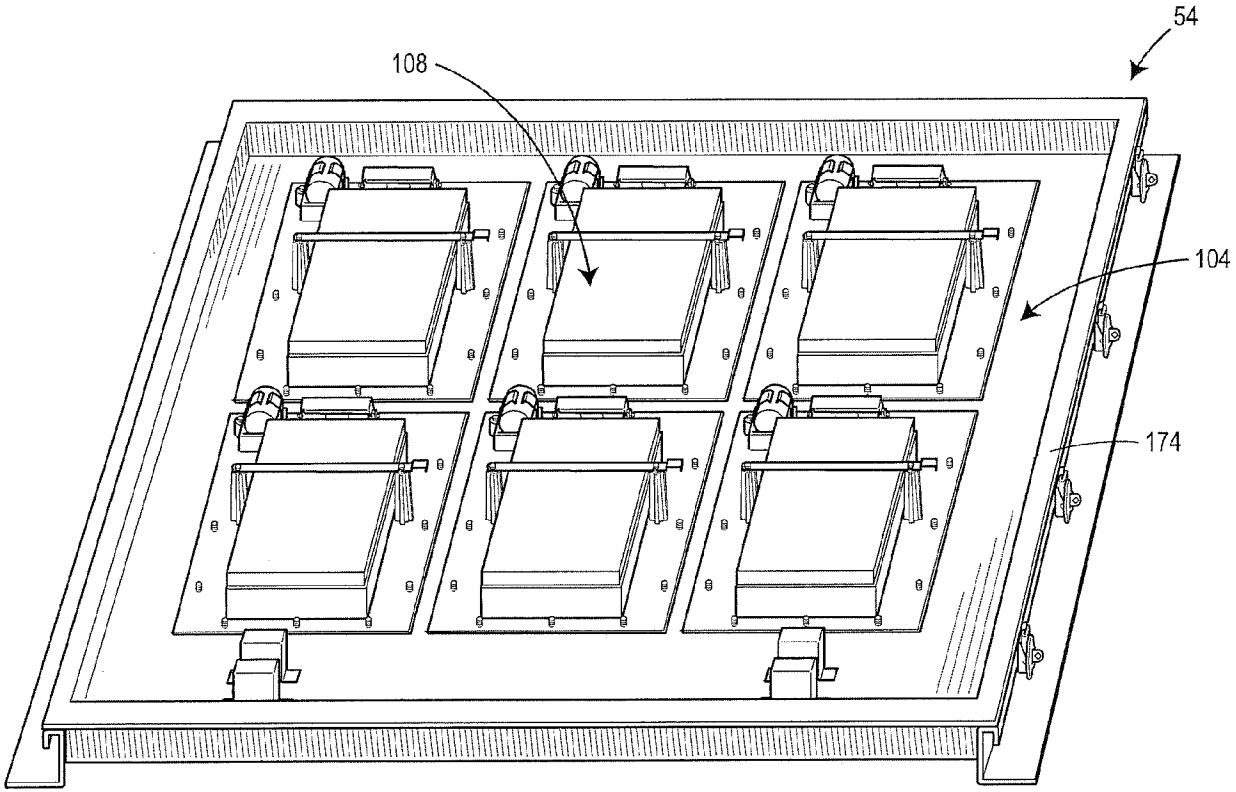
FIG. 3 is a perspective view of the driver box of FIG. 2, but with the cover of the driver box removed.
Figure 4:
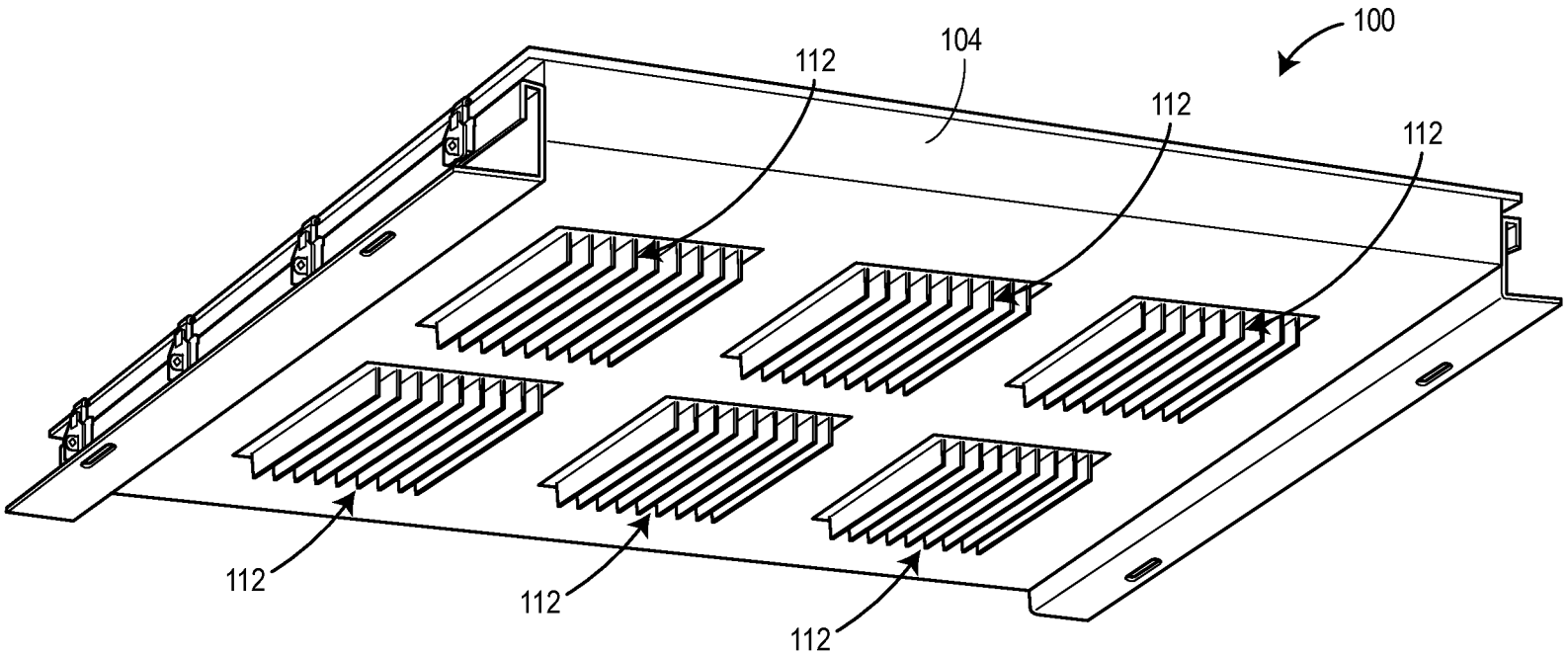
FIG. 4 is a bottom perspective view of the driver box of FIG. 2.

FIGS. 2-4 illustrate one example of a driver box 54 constructed in accordance with the present disclosure. In this example, the driver box 54 includes a housing 104, six (6) drivers 108 disposed (e.g., installed, secured) within the housing 104, and six (6) heat sinks 112 associated with and configured to dissipate heat generated by a respective one of the drivers 108. As shown in FIG. 2, the drivers 108 are in this example arranged in rows and columns within the housing 104. Each driver 108 includes various components configured to provide electric power to one or more luminaires 58. In some versions, each driver 108 can output electric power in a range of 300-500 Watts, which, in some cases, is sufficient to supply adequate electric power to four (4) to eight (8) luminaires 58. In these versions, the driver box 54, having six (6) drivers 108, can supply electric power to twenty-four (24) luminaires 58. As will be described in greater detail below, each driver 108 can be quickly and easily coupled to one of the conductors 62 noted above, but can also be quickly and easily changed out (i.e., removed from the housing 104, and interchanged with another driver 108), when desired.

It should be appreciated that the drivers 108 can be arranged differently within the driver box 100. In other examples, the driver box 100 can include more or less drivers 108. For example, the driver box 100 can include two (2), four (4), or some other number of drivers 108. As such, the driver box 100 can include more or less heat sinks 112. When, for example, the driver box 100 includes two (2) or four (4) drivers 108, the driver box 100 can include two (2) or four (4) heat sinks 112. It should be appreciated that the number of heat sinks 112 can vary from the number of drivers 108.

Figure 5:
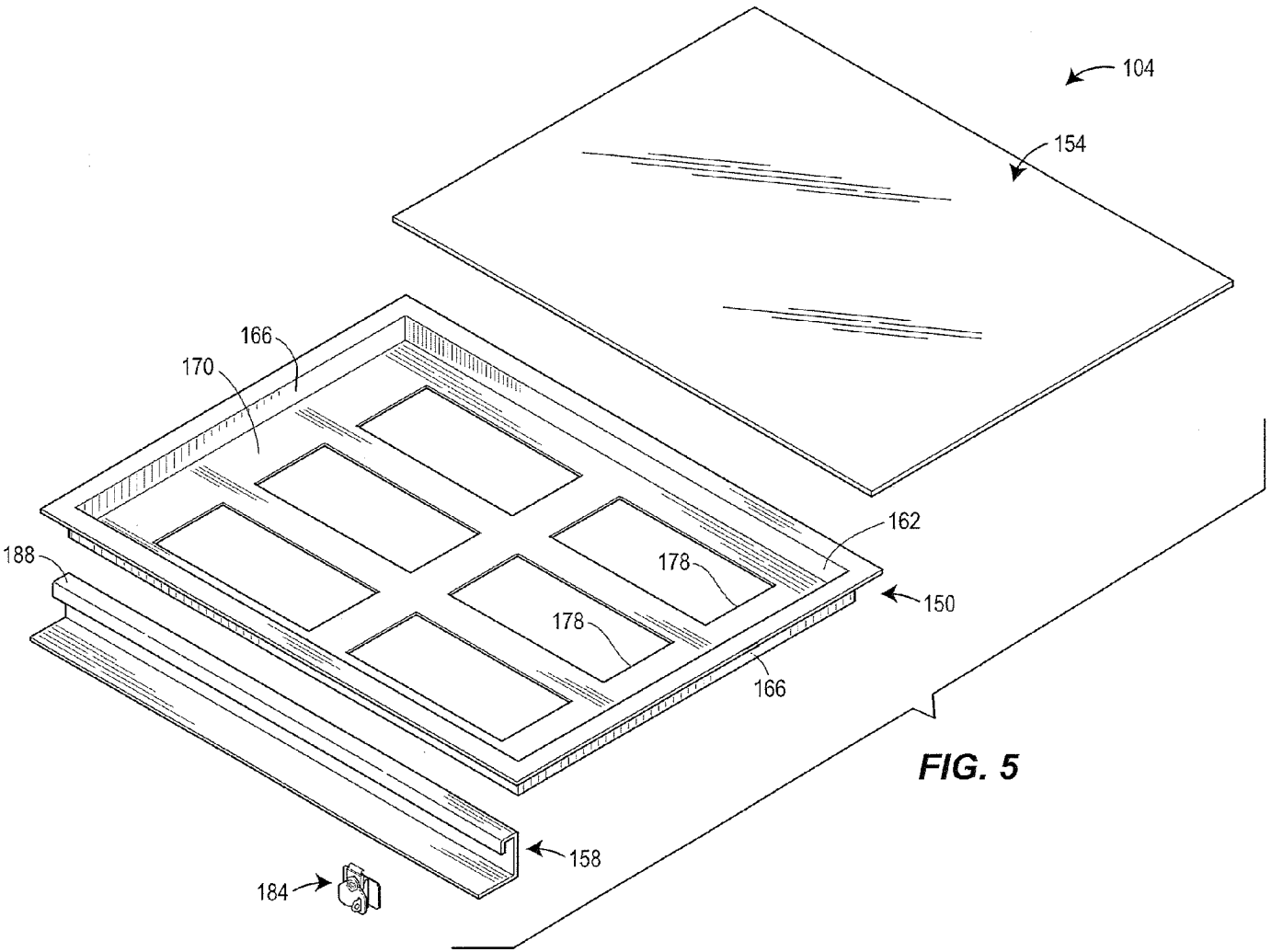
FIG. 5 is a perspective, exploded view of components of a housing of the driver box of FIG. 2.

FIG. 5 is an exploded view of some of the components of the housing 104. The housing 104 in this example is made entirely of stainless steel (e.g., 316 Stainless Steel, 304 Stainless Steel). As shown in FIG. 12, the housing 104 in this example is defined by a body 150, a cover 154 movably coupled to the housing body 150, and a base 158 coupled to the housing body 150.

The body 150 includes a pair of longitudinally extending opposing sidewalls 162, a pair of transversely extending opposing sidewalls 166, and a bottom wall 170 connected to and disposed between the sidewalls 162, 166. The sidewalls 162, 166 extend upward from the bottom wall 170. The body 150 also includes a wall portion 174 coupled to and extending laterally outward from a top portion of each of the sidewalls 162, 166, such that the wall portions 174 hang over the sidewalls 162, 166 (see FIG. 3). The body 150 also includes six rectangularly-shaped openings 178 formed or defined in the bottom wall 170. Each opening 178 is generally sized to receive one of the drivers 108, as will be described in greater detail below.

The cover 154 has a length that is substantially equal to a length of the sidewalls 162 and a width that is substantially equal to a length of the sidewalls 166. In this version, the cover 154 is a door that is rotatably coupled to the body 150 via a plurality of hinges (not visible) coupled to an exterior portion of one of the sidewalls 166. The cover 154 can be rotated between a closed position (see FIG. 2), in which a bottom surface of the cover 150 rests on the wall portions 174 and serves to close the housing 104, and an open position (not shown), in which the cover 154 is spaced from the top portions of the sidewalls 162, 166 such that the interior contents of the housing 104 are accessible. The cover 154 can be secured in the closed position via a plurality of locks or latches 184. The latches 184 are, as shown in FIG. 5, rotary latches, but can, in other versions, be a different type of latch or lock (e.g., a cam lock, a spring latch).

The base 158 is coupled to and extends downwardly from an underside of the housing body 150. The base 158 serves to support the housing 104, but can also be used to mount the driver box 54, for example to a ceiling. In this example, the base 158 includes two (2) supports 188 that are coupled to and extend downwardly and outwardly from an underside of the wall portions 174 of the housing body 150. Only one support 188 is depicted in FIG. 5, as the supports 188 are structurally identical to one another.

In other versions, the housing 104 can be constructed differently. Specifically, the body 150, the cover 154, and/or the base 158 can have a different size, shape, and/or be made of one or more materials other than or in addition to stainless steel. For example, the body 150 can include more or less openings 178, particularly when the driver box 54 includes more or less drivers 108 than the driver box 54 depicted in FIG. 3. In other versions, the cover 154 can be a door, a lid, a cover panel, or some other closure device. The cover 154 can, in some versions, include a window made of glass, plastic (e.g., acrylic plastic, polycarbonate plastic), or some other material. The cover 154 can, in some versions, be coupled to the body 150 in a different way. Moreover, while the cover 154 is described as being rotatably connected to the body 150 of the housing 104, the cover 154 can, in other versions, be slidably coupled to the body 150 or not connected to the body 150 at all except for the latches 184. As another example, the base 158 can be or include more or less supports, one or more legs, one or more feet, one or more stands, or one or more other support structures.

With reference back to FIG. 3, the driver box 54 in this example further includes six (6) driver supports or retainers 200 disposed in the housing 104, particularly over and around the openings 178 defined in the housing 104. Each of the retainers 200 is configured to receive and securely retain a respective one of the six (6) drivers 108 therein.

Figure 6:
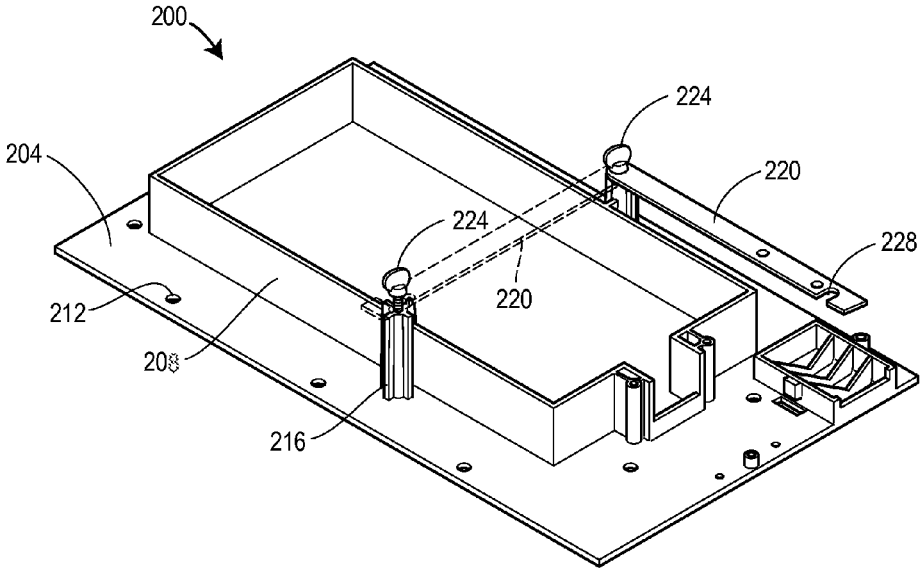
FIG. 6 is a perspective view of one example of a retainer employed in the driver box of FIG. 2.

FIG. 6 illustrates an example of one of the retainers 200. In this version, the retainer 200 is made of the same material as the housing 104 (e.g., Stainless Steel) and has a bottom 204 and a frame 208 surrounding the bottom 204. The retainer 200 in this version also includes a plurality of circumferentially-spaced apertures 212 each configured to receive a fastener (e.g., a screw, a rivet, a PEM stud, a nut, etc.) to secure the retainer 200 to the housing 104, particularly the bottom wall 170 of the housing 104. The retainer 200 further includes a pair of posts 216 and a latch 220 rotatably coupled to one of the posts 216. The posts 216 are coupled to and extend upward from the bottom 204 of the retainer 200. As shown in FIG. 6, the latch 220 has one end secured to one of the posts 216 by a fastener 224 (e.g., a screw. a rivet, a PEM stud, a nut, etc.), and a free end that has a U-shaped notch 228 defined therein. Disposed in and protruding outward from the other post 216 is another fastener 224 configured to serve as a catch for the latch bar 220, particularly the notch 228 defined in the free end of the latch bar 220. As shown in dashed lines in FIG. 6, the latch 220 can be rotated about the post 216 to a second position in which the notch 228 engages the fastener 224 on the other post 216. In this second position, the latch 220 can be configured to securely retain the driver 108 disposed in the retainer 200.

In other versions, the driver box 54 can include more or less retainers 200. The driver box 54 can, for example, include more or less retainers 200 when the driver box 54 includes more or less drivers 108. In some versions, one or more of the retainers 200 can include one or more discrete or separately formed sections or parts, and each section or part can be considered a separate retainer. In other versions, one or more of the retainers 200 can vary from the retainer 200 illustrated in FIG. 6. Specifically, the retainer(s) 200 can vary in shape and/or size. For example, the retainer(s) 200 can have a circular, oblong, triangular, irregular, or other shape. As another example, the retainer(s) 200 need not include the latch 200. The retainer(s) 200 can, for example, utilize a tie, band, strap, belt, clamp, pin, or other securing means to securely retain the driver(s) 108 therein.

In other versions, the retainer(s) 200 can be secured to the housing 104 in a different manner. For example, the retainer (s) 200 can be glued, snapped, or otherwise attached to the housing 104. Additionally, while the retainers 200 are described as being made of the same material as the housing 104, specifically Stainless Steel, one or more of the retainers 200 can, in other versions, be made of a different material than the housing 104 and/or one or more different materials.

With reference again back to FIG. 3, the driver box 54 further includes six (6) connection mechanisms 250 disposed in the housing 104 near, adjacent, or in proximity to a respective one of the retainers 200. Each connection mechanism 250 is configured to facilitate a quick and easy mechanical and electrical connection between a respective one of the drivers 108 and one or more of the luminaires 58. Each connection mechanism 250 is also configured to facilitate a quick and easy change system by which drivers 108 can be quickly and easily disconnected and replaced or repaired and re-connected.

Figure 7:
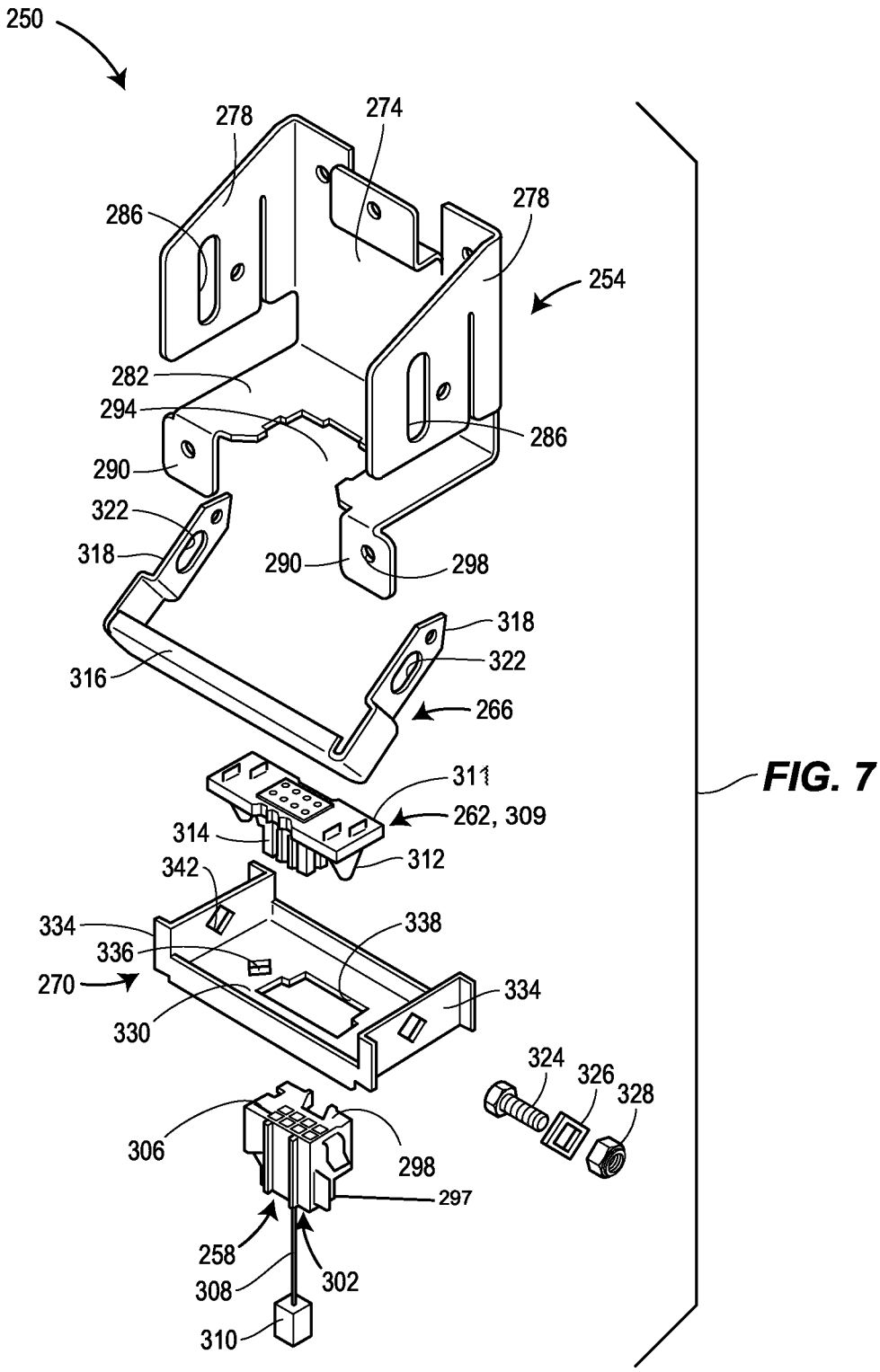
FIG. 7 is a perspective, exploded view of components of one example of a connection mechanism employed in the driver box of FIG. 2.

FIG. 7 depicts an exploded view of one of the connection mechanisms 250. As shown in FIG. 7, the connection mechanism 250 in this version includes a mounting bracket 254, a first electrical connector 258, a second electrical connector 262, an actuator 266, and a cam mechanism 270.

As shown in FIG. 7, the mounting bracket 254 is defined by a bottom wall 274, a pair of side walls 278 that are coupled to and extend upward from the bottom wall 274, and a front wall 282 that is also coupled to and extends upward from the bottom wall 274. A slot 286 is defined in each of the side walls 278. In this version, the slots 286 have a generally cylindrical shape. The front wall 282 includes a pair of outwardly extending tabs 290 and an opening 294. The tabs 290 each include an aperture 298 configured to receive a fastener (e.g., a screw, a rivet, a PEM stud, a nut, etc.) for securing the tabs 290, and, more generally, the front wall 282 to one of the retainers 200. The opening 294 has an irregular shape sized to accommodate the first electrical connector 258.

The first and second electrical connectors 258, 262 are generally configured to mate with one another. In the version depicted in FIG. 7, the first electrical connector 258 is a female plug 297 that has a first end 298, a second end 302 opposite the first end 298, and a plurality of sockets or recesses 306 defined in the first end 298 and extending through a portion of the plug 297. The first electrical connector 258 can have any number of sockets 306 (e.g., eight sockets 306, sixteen sockets 306). The first electrical connector 258 also includes one or more conductors 308 that extend outward from the second end 302. Each conductor 308 includes a male plug 310. As will be described in greater detail below, the male plug 310 can be electrically coupled to a mating female plug included with a corresponding driver 108 to couple the corresponding driver 108 to the one or more conductors 308 and, in turn, the first electrical connector 258.

In the version depicted in FIG. 7, the second electrical connector 262 is a male plug 309 that has a base 311, a pair of rectangular projections 312 that extend outward from the base, and a plurality of pins 314 that extend outward from the base 311 between the projections 312. The second electrical connector 262 can have any number of pins 314 (e.g., eight pins 314, sixteen pins 314). As will be described in greater detail below, the plurality of pins 314 are configured to be inserted or disposed in the sockets 306 such that the first and second electrical connectors 258, 262 are in mating engagement with, and electrically connected to, one another. Although not depicted herein, the second electrical connector 262 is electrically connected with one or more luminaires 58 via one or more conductors (e.g., the one or more conductors 62).

In the version depicted in FIG. 7, the actuator 266 is a pivotable handle that includes a gripping portion 316, a pair of projections 318 that extend project outward from opposite ends of the gripping portion 314, respectively, and a pair of apertures 322 defined in the projections 318, respectively. Each aperture 322 is sized to receive fastening elements, such as a screw 324, a washer 326, and a nut 328, configured to movably couple (e.g., secure) the actuator 266 to the mounting bracket 254.

The cam mechanism 270 operatively couples the actuator 266 to the second electrical connector 262, such that movement of the actuator 266 results in movement of the second electrical connector 262. The cam mechanism 270 in this version is a plate that has a bottom 330 and a pair of opposing sides 334 that extend upward from the bottom 330. The bottom 330 is generally configured to accommodate the second electrical connector 262. Specifically, the bottom 330 includes a pair of rectangular openings 336 sized to receive the projections 312 of the second electrical connector 262 to secure the second electrical connector 262 to the cam mechanism 270, and includes a generally rectangular opening 338, larger than the openings 336, sized to accommodate the plurality of pins 314 of the second electrical connector 262, such that the pins 314 extend outward of the cam mechanism 270. Each of the sides 334 includes an aperture 342 positioned to be aligned with the apertures 322 of the actuator 266 when the actuator 266 is coupled to the mounting bracket 254 and configured to receive the respective fastening elements (e.g., the screw 324, the washer 326, and the nut 328).

In other versions, the driver box 54 can include more or less connection mechanisms 250. The driver box 54 can, for example, include more or less connection mechanisms 250 when the driver box 54 includes more or less drivers 108. In other versions, one or more of the connection mechanisms 250 can vary in shape, size, and/or components from the connection mechanism 250 illustrated in FIG. 7. In some versions, the first and/or second electrical connectors 258, 262 can vary. For example, the first electrical connector 258 can be the male plug 309 and the second electrical connector 262 can be the female plug 297. As another example, the first and/or second electrical connectors 258, 262 can taken on a different form, such as, for example, couplings, channels, notches, latches, different plugs. In yet another example, the first electrical connector 258 can be integrally coupled (e.g., fixed) to the driver 108, obviating the need for the plugs 310, 358. Alternatively or additionally, the actuator 266 can be a lever, a latch, or take on any other suitable form. In some versions, the cam mechanism 270 can vary in shape and/or size and yet still perform the intended function of operatively coupling the second electrical connector 262 to the actuator 266.

Figure 8:
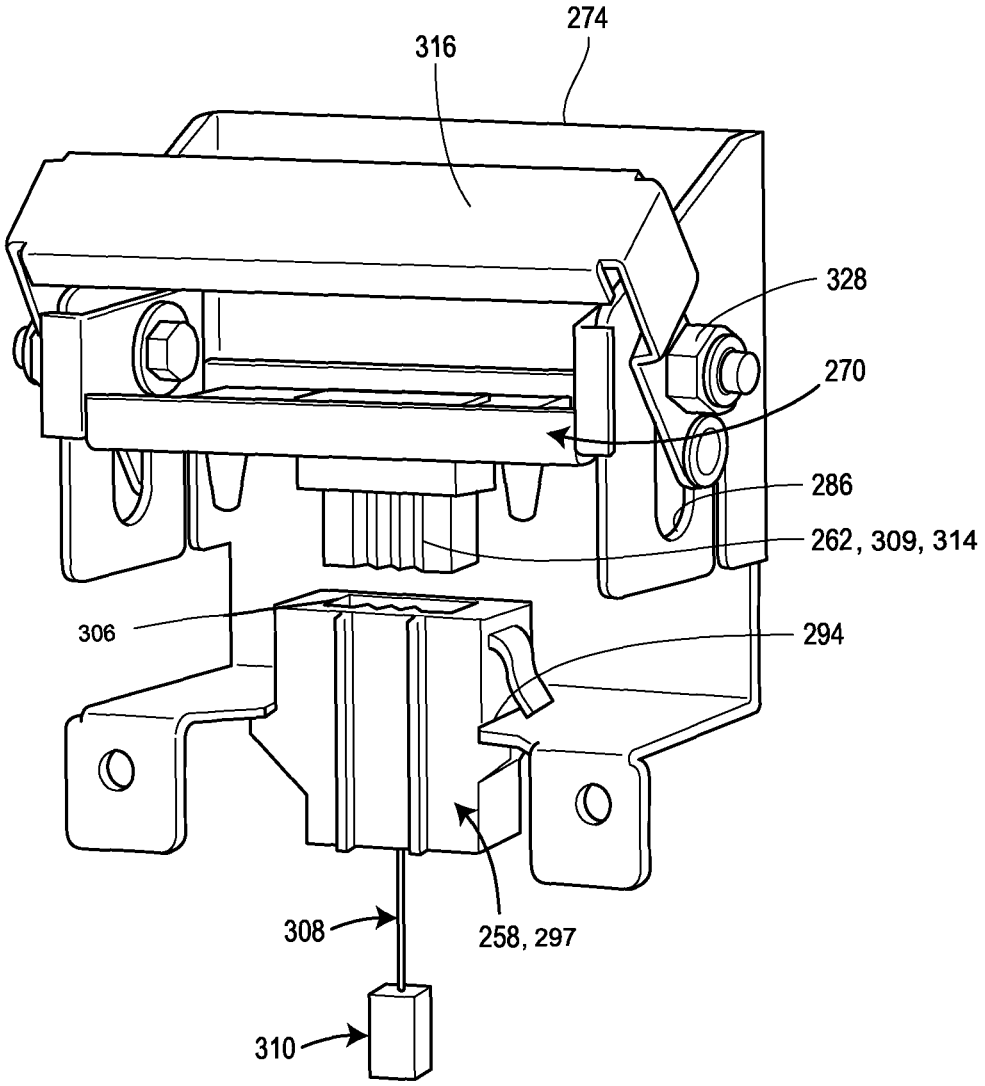
FIG. 8 is a perspective view of the connection mechanism shown in FIG. 7, as assembled and in a first position.

FIG. 8 is a close-up view of one of the connection mechanisms 250, as assembled and in a first position. It should be appreciated that the other connection mechanisms 250 in the driver box 54 are assembled in a similar manner. As partially shown in FIG. 8, the first electrical connector 258 is disposed within the opening 294 defined in the mounting bracket 274. The second electrical connector 262, which, as noted above, is electrically connected to one or more luminaires 58, is disposed within the cam mechanism 270, with the projections 312 disposed in the openings 336 of the cam mechanism 270 (not shown in FIG. 8) and the pins 314 disposed in and extending through the opening 338 of the cam mechanism 270. The cam mechanism 270, with the second electrical connector 262 disposed therein, can, in turn, be coupled to the actuator 266 by aligning the apertures 322 and the apertures 342 with the slots 286 and inserting the fastening elements (e.g., the screws 324, the washers 326, and the nuts 328) into the aligned apertures 322 and the slots 286. As such, the second electrical connector 262 and the actuator 266 are operatively coupled to one another via the cam mechanism 270. Moreover, the first electrical connector 258 is axially aligned with the second electrical connector 262 as shown in FIG. 8, though in other versions the connectors 258, 262 can be aligned or arranged in some other way.

Figure 9:
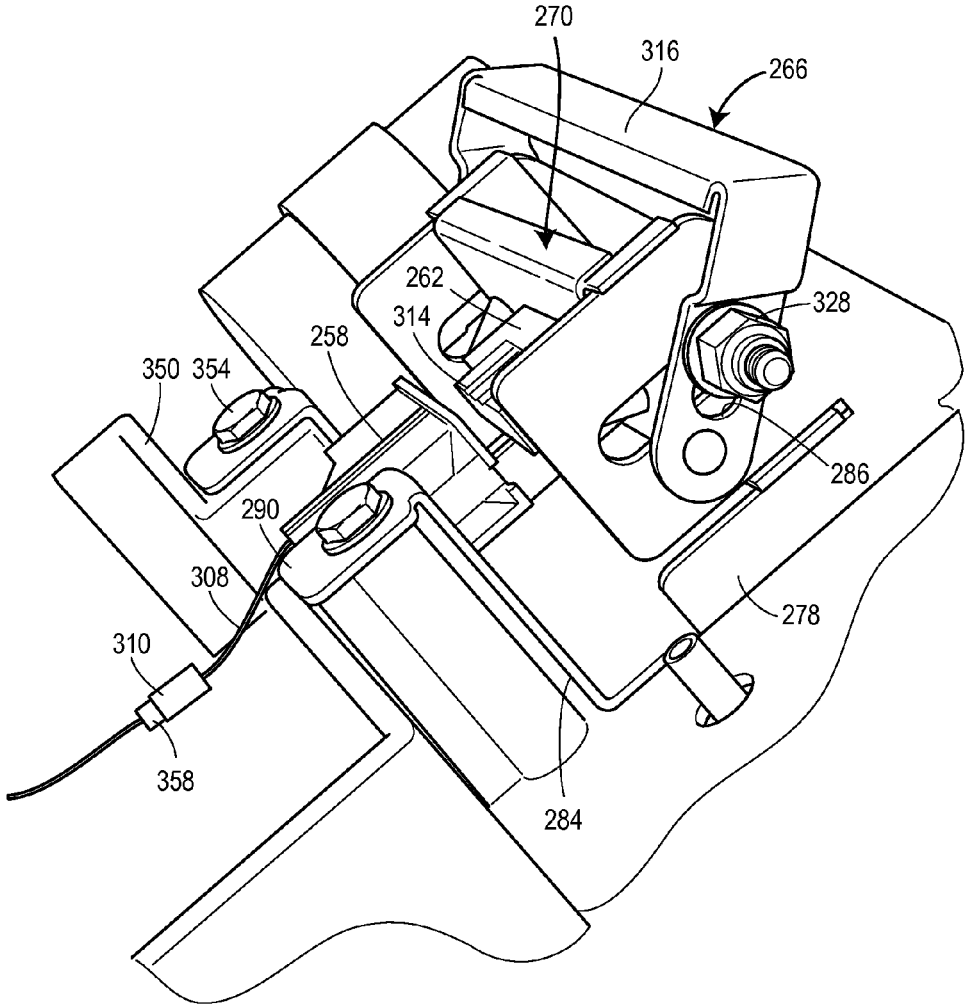
FIG. 9 is a close-up view of the connection mechanism shown in FIG. 8 when the connection mechanism is disposed in the driver box of FIGS. 2-4 and is in the first position.

FIG. 9 is a close-up view of one of the connection mechanisms 250 when disposed in the housing 104 of the driver box 54. It should be appreciated that the other connection mechanisms 250 disposed in the driver box 54 are disposed in a similar manner. As shown in FIG. 9, the connection mechanism 250 is coupled to a respective one of the retainers 200. Specifically, the front wall 282 of the mounting bracket 254 is positioned in contact with an upstanding portion of a respective one of the frames 208, with the tabs 290 disposed over and in contact with a perimeter edge 350 of the respective frame 208 and secured there via a plurality of fasteners 354. In turn, the first electrical connector 258 is disposed between portions of the respective frame 208 and the tabs 290 disposed thereon, such that the first electrical connector 258 is coupled (e.g., fixed, secured) to the housing 104 So disposed, the conductor 308 and, in turn, the male plug 310 extend into an interior of the respective retainer 200.

FIG. 9 also shows one of the drivers 108 disposed within in a respective one of the retainers 200 and coupled to the respective connection mechanism 250. It should be appreciated that the other drivers 108 are also disposed in the respective other retainers 200 in the driver box 54 and coupled to the respective other connection mechanisms 250 in the driver box 54 in a similar manner.

As shown in FIG. 9, the driver 108 is disposed such that a female plug 350 extending from one end of the driver is adjacent the male plug 310 connected to the first electrical connector 258. So disposed, the female plug 350 of the driver 108 can be inserted into the male plug 310, such that there is a mechanical and electrical connection between the driver 108 and the first electrical connector 258.

Although the connection between the plugs 310, 350 can serve to securely retain the driver 108 in the housing 104, the driver 108 can be further secured within the housing 104, and, more particularly, within the retainer 200. With reference back to FIG. 6, this can be done by rotating the latch 200 from the position shown in solid lines to the position shown in dashed lines. This can be done at any time. In some versions, the driver 108 can be further secured within the retainer 200 in this way after the plug 350 is connected to the plug 310 and before the connection mechanism 250 is moved from the first position to the second position, as described below. In other versions, the driver 108 can be further secured within the retainer 200 in this way after the driver 108 is disposed in the retainer 200 and before the plug 350 is connected to the plug 310. In yet other versions, the driver 108 can be further secured within the retainer 200 in this way after the plug 350 is connected to the plug 310 and after the connection mechanism 250 is moved to the second position.

Figure 10:
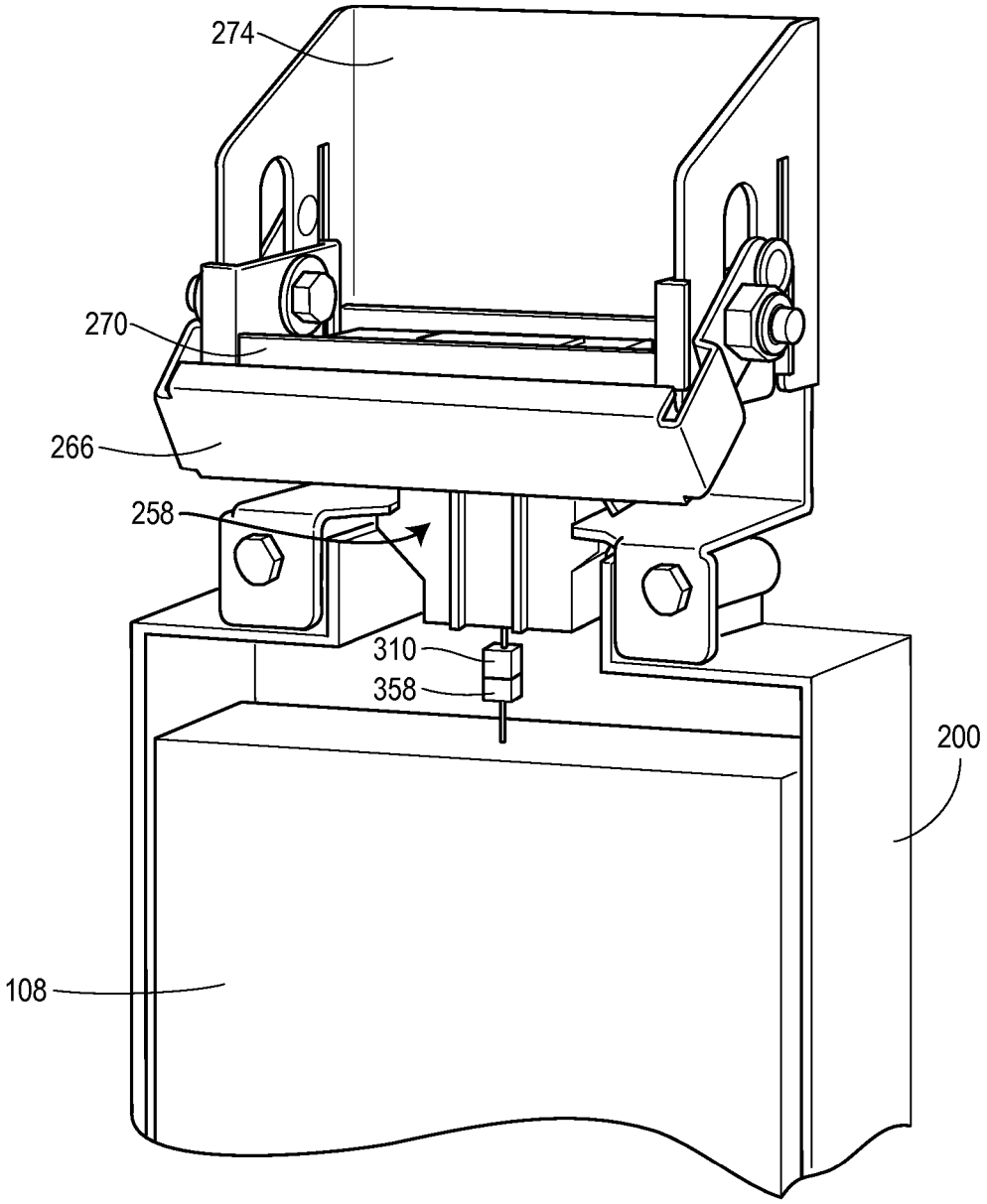
FIG. 10 is similar to FIG. 9, but with several components removed and the connection mechanism moved to a second position.

In FIG. 9, the connection mechanism 250 is in a first position in which the actuator 266 is in an unlocked position and the first electrical connector 258 is spaced apart from the second electrical connector 262, with the result being that the driver 108 is not electrically connected to the one or more downstream luminaires 58. The driver 108 can, however, be quickly and easily electrically connected to the one or more downstream luminaires 58 by moving the connection mechanism 250 from the first position to a second position, which is depicted in FIG. 10. To this end, a user of the driver box 54 can, using the gripping portion 314 of the actuator 266, rotate the actuator 266 from the unlocked position shown in FIG. 9 to a locked position, which is shown in FIG. 10. Rotation of the actuator 266 from the unlocked position to the locked position causes the cam mechanism 270 to move, which, in turn, causes the second electrical connector 262 to move (e.g., slide) toward and into mating engagement with the first electrical connector 258. Specifically, rotation of the actuator 266 causes the fasteners 324 to rotate, which, in turn, drives the cam mechanism 270, and the second electrical connector 262, toward the first electrical connector 258 until the pins 314 of the second electrical connector 262 are inserted or disposed into the sockets 306 of the first electrical connector 262.

When the connection mechanism 250 is in the second position shown in FIG. 10, the first and second electrical connectors 258, 262 are mechanically and electrically connected to one another. As a result, the driver 108 is electrically connected, and can supply power, to the one or more downstream luminaires 58.

In the event that a driver 108 in the driver box 54 requires maintenance (e.g., the driver 108 needs to be repaired or replaced), the driver 108 in need of maintenance can be quickly and easily disconnected in a similar manner. The user of the driver box 54 can move the connection mechanism 250 from the second position back to the first position, in which the actuator 266 is in the unlocked position and the first electrical connector 258 is spaced apart from the second electrical connector 262. To this end, the user of the driver box 54 can, using the gripping portion 314 of the actuator, rotate the actuator 266 from the locked position shown in FIG. 10 to the unlocked position shown in FIG. 9. Rotation of the actuator 266 from the locked position to the locked position causes the cam mechanism 270 to move, which, in turn, moves (e.g., drives) the second electrical connector 262 away from and out of mating engagement with the first electrical connector 258. Specifically, rotation of the actuator 266 causes the fasteners 324 to rotate, which, in turn, drives the cam mechanism 270, and the second electrical connector 262, away from the first electrical connector 258 until the pins 314 of the second electrical connector 262 are removed and spaced apart from the sockets 306 of the first electrical connector 262.

With the first and second electrical connectors 258, 262 disconnected from one another, the driver 108 is no longer electrically connected to the one or more downstream luminaires 58. The plug 358 of the driver 108 can, in turn, be disconnected from the plug 310 of the first electrical connector 258, such that the driver 108 can be removed from the respective retainer 200 and, more generally, the driver box 54, at which time the driver 108 can be repaired and then reinstalled in the driver box 54 or the driver 108 can be replaced with a different, properly functioning driver 108. In any event, the driver 108 can be removed from the respective retainer while "hot." In other words, the driver 108 can be removed while the driver the rest of the lighting system 50 continues to operate (e.g., the other drivers 108 in the box 54 can continue to supply power to the luminaires 58). In other words, maintenance can be performed in connection with the driver 108 without interrupting the operation of the rest of the lighting system 50.

It should be appreciated that all or any portion of the above-described process can be repeated any number of times for any number of drivers 108 or driver boxes 54.

Based on the foregoing description, it should be appreciated that the driver box described herein is configured to facilitate a quick and easy connection between one or more drivers disposed therein and one or more luminaires connected to the driver box, but also configured to permit or allow one or more of the drivers 108 to be "hot swapped." In other words, one or more of the drivers can be quickly and easily disconnected and removed from the driver box without affecting the operation of the rest of the lighting system, such as, for example, the other drivers disposed in the driver box. As such, the disclosed driver box can reduce the time, cost, difficulty, and inconvenience typically associated with maintaining (e.g., repairing, replacing) drivers disposed therein.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

As used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Some embodiments may be described using the expression "coupled" and "connected" along with their derivatives. For example, some embodiments may be described using the term "coupled" to indicate that two or more elements are in direct physical or electrical contact. The term "coupled," however, may also mean that two or more elements are not in direct contact with each other, but yet still cooperate or interact with each other. The embodiments are not limited in this context.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the description. This description, and the claims that follow, should be read to include one or at least one and the singular also includes the plural unless it is obvious that it is meant otherwise.

This detailed description is to be construed as examples and does not describe every possible embodiment, as describing every possible embodiment would be impractical, if not impossible. One could implement numerous alternate embodiments, using either current technology or technology developed after the filing date of this application.

The invention claimed is:

1. A driver box adapted to be coupled to at least one luminaire, the driver box comprising:

a housing adapted to removably secure a driver adapted to supply electric power to the at least one luminaire; and a connection mechanism disposed in the housing, the connection mechanism having an actuator, a first electrical connector, and a second electrical connector, the first electrical connector configured to be connected to the driver, the second electrical connector being configured to be electrically connected to the at least one luminaire, and the actuator operatively coupled to the second electrical connector, wherein the actuator is movable between an unlocked position, in which the second electrical connector is disengaged from the first electrical connector, and a locked position in which the second electrical connector is in mating engagement with the first electrical connector.

2. The driver box of claim 1, wherein movement of the actuator from the unlocked position to the locked position drives the second electrical connector toward and into mating engagement with the first electrical connector.

3. The driver box of claim 1, wherein movement of the actuator from the locked position to the unlocked position moves the second electrical connector out of mating engagement with the first electrical connector.

4. The driver box of claim 1, further comprising a driver support disposed in the housing, the driver support adapted to receive a driver, and the connection mechanism being disposed adjacent the driver support.

5. The driver box of claim 4, further comprising a latch coupled to the driver support, the latch movable between an open position, in which a driver can be removed from the driver support, and a closed position, in which the latch can secure a driver within the driver support.

6. The driver box of claim 5, wherein the latch defines a notch, the notch configured to engage a catch disposed on the driver support when the latch is in the closed position.

7. The driver box of claim 1, wherein one of the first and second electrical connectors comprises a female plug having a plurality of sockets and the other of the first and second electrical connectors comprises a male plug having a plurality of pins configured to be inserted into the plurality of sockets, respectively.

8. The driver box of claim 1, wherein the second electrical connector is slidable into and out of mating engagement with the first electrical connector.

9. The driver box of claim 1, wherein the first and second electrical connectors are axially aligned with one another.

10. The driver box of claim 1, wherein the connection mechanism comprises a mounting bracket, the actuator and the second electrical connector being movably coupled to the mounting bracket.

11. The driver box of claim 1, wherein the connection mechanism comprises a cam mechanism that operatively couples the actuator to the second electrical connector.

12. The driver box of claim 11, wherein the actuator defines a pair of first slots, the mounting bracket defines a pair of second slots configured to cooperate with the first slots, respectively, and the cam mechanism is guided by the cooperation of the first and second slots.

13. A connection mechanism adapted to be disposed in a driver box that is adapted to be coupled to at least one luminaire and adapted to removably secure a driver adapted to supply electric power to the at least one luminaire, the connection mechanism comprising:

a mounting bracket adapted to be coupled to the driver box;

an actuator movably coupled to the mounting bracket, the actuator movable between an unlocked position and a locked position;

a first electrical connector carried by the mounting bracket and configured to be coupled to the driver;

a second electrical connector operatively coupled to the actuator and configured to be electrically connected to the at least one luminaire, and a cam mechanism movably disposed in the mounting bracket and configured to operatively couple the actuator to the second electrical connector, wherein when the actuator is in the unlocked position, the second electrical connector is disengaged from the first electrical connector, and wherein movement of the actuator from the unlocked position to the locked position drives the second electrical connector into mating engagement with the first electrical connector, and wherein the actuator defines a pair of first slots, the mounting bracket defines a pair of second slots configured to cooperate with the first slots, respectively, and the cam mechanism is movably guided by the cooperation of the first and second slots.

14. The connection mechanism of claim 13, wherein movement of the actuator from the locked position to the unlocked position pulls the second electrical connector out of mating engagement with the first electrical connector such that the driver is electrically disconnected from the at least one luminaire.

15. The connection mechanism of claim 13, wherein the first electrical connector comprises a female plug having a plurality of sockets and the second electrical connector comprises a male plug having a plurality of pins configured to be inserted into the plurality of sockets, respectively.

16. The connection mechanism of claim 13, wherein the second electrical connector is slidable into and out of mating engagement with the first electrical connector.

17. The connection mechanism of claim 13, wherein the second electrical connector is at least partially disposed through the cam mechanism.

18. A lighting system, comprising:

at least one luminaire; and a driver box adapted to supply electric power to the at least one luminaire via at least one conductor, the driver box comprising:

a housing;

first and second drivers removably disposed in the housing, each of the first and second drivers being configured to supply electric power to the at least one luminaire; and first and second connection mechanisms disposed in the housing and electrically connected to the at least one luminaire, the first and second connection mechanisms movable between a first position, in which the first and second drivers are not electrically connected to the at least one luminaire, and a second position, in which the first and second drivers can be electrically connected to the at least one luminaire, wherein when the first connection mechanism is in the first position and the second connection mechanism is in the second position, the first driver can be removed from the housing while the second driver can supply electric power to the at least one luminaire.

19. The lighting system of claim 18, wherein each of the connection mechanisms comprises:

an actuator movable between an unlocked position and a locked position, the unlocked position corresponding to the first position, and the locked position corresponding to the second position;

a first electrical connector configured to be coupled to a respective one of the first and second drivers; and a second electrical connector operatively coupled to the actuator, wherein movement of the actuator from the unlocked position to the locked position drives the second electrical connector into mating engagement with the first electrical connector, such that the respective driver is electrically connected to the at least one luminaire.

20. The lighting system of claim 19, wherein movement of the actuator from the locked position to the unlocked position pulls the second electrical connector out of mating engagement with the first electrical connector such that the respective driver is electrically disconnected from the at least one luminaire.

21. The lighting system of claim 19, wherein each of the first electrical connectors comprises a female plug having a plurality of sockets and each of the second electrical connectors comprises a male plug having a plurality of pins configured to be inserted into the plurality of sockets, respectively, of the respective female plug.

22. The lighting system of claim 19, wherein each of the connection mechanisms further comprises a mounting bracket, the actuator and the second electrical connector being movably coupled to the mounting bracket.

23. The lighting system of claim 19, wherein each of the connection mechanisms comprises a cam mechanism that operatively couples the actuator to the second electrical connector.

24. The lighting system of claim 18, wherein the driver box further comprises first and second driver supports disposed in the housing, the first and second driver supports adapted to receive the first and second drivers, respectively, and the first and second connection mechanisms disposed adjacent the first and second driver supports, respectively.

25. A connection mechanism adapted to be disposed in a driver box that is adapted to be coupled to at least one luminaire and adapted to removably secure a driver adapted to supply electric power to the at least one luminaire, the connection mechanism comprising:

an actuator movable between an unlocked position and a locked position;

a first electrical connector configured to be coupled to the driver;

a second electrical connector operatively coupled to the actuator and configured to be electrically connected to the at least one luminaire;

a mounting bracket adapted to be coupled to the driver box; and a cam mechanism movably disposed in the mounting bracket and configured to operatively couple the actuator to the second electrical connector, wherein when the actuator is in the unlocked position, the second electrical connector is disengaged from the first electrical connector, and wherein movement of the actuator from the unlocked position to the locked position drives the second electrical connector into mating engagement with the first electrical connector, and wherein the actuator defines a pair of first slots, the mounting bracket defines a pair of second slots configured to cooperate with the first slots, respectively, and the cam mechanism is movably guided by the cooperation of the first and second slots.

* * * * *